United States Patent [19]

Muusse

[11] 4,005,511

[45] Feb. 1, 1977

[54] METHOD AND APPARATUS FOR CASTING EXTRUSION DIES

[75] Inventor: Jay H. Muusse, Spring Lake, Mich.

[73] Assignee: Tuff-Ten Corporation, Sparta, Mich.

[22] Filed: July 3, 1975

[21] Appl. No.: 593,025

[52] U.S. Cl. ..... 29/33 C; 29/527.6; 164/125; 249/108; 269/43

[51] Int. Cl.[2] ..... B22C 9/08; B22C 9/06; B22C 9/20

[58] Field of Search ..... 164/69, 125, 131, 132, 164/369; 29/527.6, 33 C; 249/105, 108, 120, 142, 109, 139; 269/43, 240

[56] References Cited

UNITED STATES PATENTS

| | | | |
|---|---|---|---|
| 695,090 | 3/1902 | Clark et al. | 249/105 X |
| 848,480 | 3/1907 | Myers | 249/105 X |
| 1,455,091 | 5/1923 | Nichols | 249/109 X |
| 2,420,003 | 5/1947 | Miller | 249/142 X |
| 2,423,151 | 7/1947 | Miller | 249/142 X |
| 3,480,070 | 11/1969 | Beetle et al. | 249/105 X |
| 3,892,516 | 7/1975 | McGrew et al. | 249/120 X |

*Primary Examiner*—Leonidas Vlachos
*Assistant Examiner*—Horace M. Culver
*Attorney, Agent, or Firm*—Price, Heneveld, Huizenga & Cooper

[57] ABSTRACT

The specification discloses a method and related apparatus for casting aluminum extrusion die blanks, both cored and uncored, of molten steel. A disc-like carbon or other suitable material mold having spaced side walls joined by a peripheral edge wall is filled through a sprue oriented tangentially on the peripheral edge wall of the mold. The center areas of the mold side walls are made thinner than the peripheral portions of the side wall and thinner than the peripheral edge wall such that the center of the mold cools more quickly from both sides thereof than the circumferential periphery of the mold. A core void can be made in the die blank by providing a non-permanent core shaped to basically the desired cross-section and adhered to an insert which fits into a receiving cavity in the inside of the mold. Extending appendages of the core are shaped outwardly towards the periphery of the mold cavity, away from the position they should finally take, to a distance sufficient to compensate for shrinkage of steel as it cools.

28 Claims, 9 Drawing Figures

METHOD AND APPARATUS FOR CASTING EXTRUSION DIES

BACKGROUND OF THE DISCLOSURE

The present invention relates to a method and apparatus for manufacturing aluminum extrusion dies. Typically, such dies comprise circular steel discs with an aperture or void in the center which has a cross-sectional shape corresponding to the desired cross-sectional shape of the aluminum extrusion to be produced. A bar of aluminum is drawn through the die aperture so as to force the aluminum to take the cross-section of the aperture.

The steel employed in the mold must be of a very hard, non-porous type. Any porosity in the die aperture of the mold will create lines on the extruded part. Worse, the porosity may create hidden defects which show up only after the aluminum extrusion has been anodized. The extruded piece would thus be put through additional manufacturing processes and expense before the defect would even show up.

Prior artisans have manufactured such extrusion dies from work-hardened steel bar stock of ASTM H-11, H-12 or H-13 steel. While other steel chemistry types might be better suited to aluminum extrusion dies, H-11, 12 and 13 steels are the best presently available. A steel specifically adapted to the extrusion die industry is not justified in work hardened bar stock lots by the quantity required.

The bar stock has a diameter corresponding to the die size needed for the particular part being extruded. Typically, the bar stock and the resulting die must have a 7 to 25 inch diameter. The bar stock is then sliced into discs of about one inch thickness. An electrical discharge machine is used to machine the desired die aperture in the center of the disc.

Such dies are then used until the die aperture is worn and they are then disposed of. While the original steel bar stock costs about one dollar a pound, the scrap value of used dies is only one to five cents per pound. Prior artisans have been unable to recast these dies into die blanks because the resultant blanks have too much porosity. The scrap dies cannot even be recycled specifically as H-11, H-12 or H-13 steel because the steel manufacturers cannot get enough of them regularly to pour the large quantities required to make a "pour" economical. This further contributes to the lack of value which the used die blanks have as scrap steel.

Some attempts have been made to melt down used dies and recast them as aluminum extrusion die blanks. To date, these attempts have not been commercially successful. One problem has been the difficulty of avoiding porosity in the die blank. This is particularly true when the blanks are cast without any void or aperture in the center. The porosity problem was somewhat lessened in situations where a permanent core, having the desired cross-sectional shape, was used in the casting process, but the difficulties encountered utilizing conventional molding techniques were still not completely overcome. Further, the use of a permanent core elevates the tooling cost. The tooling costs for conventional molding processes require that a substantial number of extrusion dies be made having the same shape, including the same die aperture shape. Unfortunately, manufacturers don't need a large multiplicity of dies having the same given shape. In contrast, a variety of different die aperture shapes are generally required for the variety of different types of extrusions which are manufactured.

Accordingly, prior artisans have continued to manufacture their aluminum extrusion dies from steel bar stock and the scrap value of the worn dies has been almost negligible. Attempts to re-melt the dies and cast them directly into die blanks have been commercial failures.

SUMMARY OF THE INVENTION

The present invention comprises a method and apparatus for casting aluminum extrusion die blanks, including both cored and uncored blanks, in which molten steel, such as can be obtained from melting worn dies is poured through a sprue in the periphery of a disc-like mold and, then contrary to typical metal molding techniques, the molten metal is cooled more rapidly in the center of the disc-like mold, from both sides thereof, and kept hotter longer at the periphery of the mold, all the way around the center area of the mold. The cooled disc is removed and the decarburization layer is mechanically removed at least in the central area of one side of the die blank.

Preferably, this is accomplished by providing a die with thick peripheral edge walls and thicker side walls around the periphery of a center area sufficiently large to accomodate the desired die aperture cross-section, and having thinner walls at the center area of each of the mold side walls. A die aperture void can be molded into the die by providing a non-permanent core shaped to basically the desired cross-section. Any extending appendages of the core are shaped outwardly towards the periphery of the mold cavity a distance sufficient to accommodate steel shrinkage.

As a result of this invention, worn aluminum extrusion dies can be re-melted and cast directly into new aluminum extrusion die blanks. Porosity in the core area is practically eliminated by the present invention. Further, it is significant that the present invention makes it possible to provide selective steel chemistry for the aluminum extrusion die industry. There is not sufficient demand presently to justify the steel manufacturers providing steel of a type specifically adapted to the aluminum extrusion die industry. The present invention makes such chemistry modifications feasible.

These and other objects, advantages and features of the present invention will be more fully understood and appreciated by reference to the written specification and appended drawings.

DESCRIPTION OF THE PREFERRED EMBODIMENT

Aluminum Extrusion Dies Generally

Figure 1:
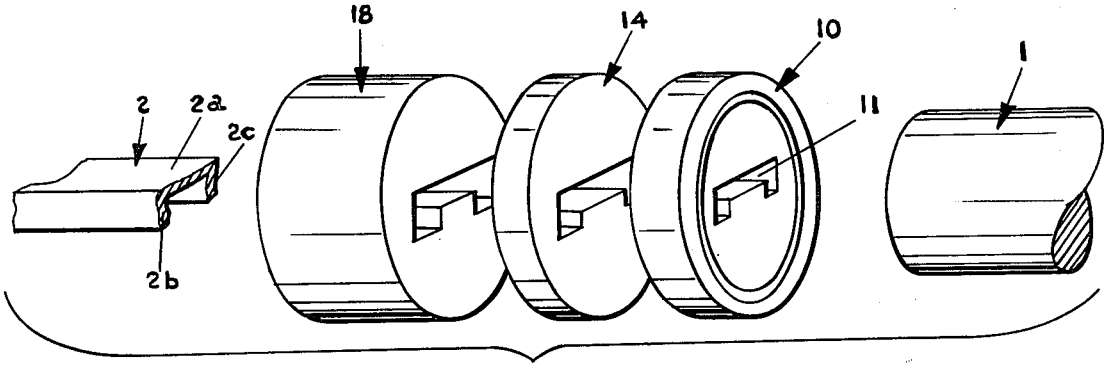
FIG. 1 is a perspective view of an aluminum extrusion die stack.
Figure 2:
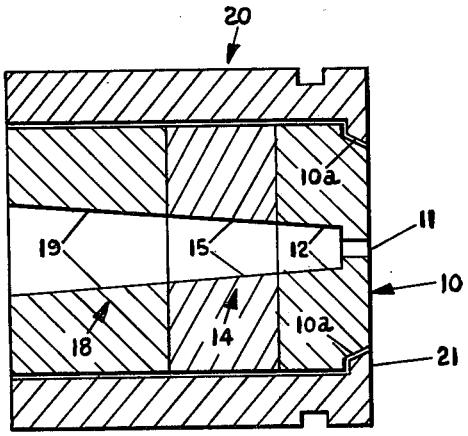
FIG. 2 is a cross-sectional view of a typical die stack, including the die holding ring.

FIGS. 1 and 2 illustrate a conventional aluminum extrusion die stack or tooling. The die 10 is primarily responsible for shaping a piece of aluminum bar stock 1 into a finally extruded piece 2. The extrusion 2 is shown to have a generally cross-sectional configuration for illustrative purposes, and comprises a bite portion 2*a* and spaced legs 2*b* and 2*c*. Die 10 has an aperture 11 corresponding in cross-sectional configuration to that desired for the extruded piece 2. Typically, the die aperture 11 has that desired shape only in the front portion of the die. In the rear half of the die, as can be seen by reference to FIG. 2, the aperture 11 expands outwardly into a rear portion 12 which still is generally U-shaped but which is larger and which does not actually contact the aluminum as it is pulled therethrough.

A backer 14 is provided which also has a generally U-shaped aperture 15. Again, however, aperture 15 is still larger than the rear aperture portion 12 of die 10 and continues to expand as one moves rearwardly along the stack. Finally, a rather thick bolster 18 is provided against which both the die and the backer rest. The bolster has an aperture 19 which, although it may have the general form of the cross-section of the extruded piece 2, is still larger in cross-sectional configuration and is not supposed to be engaged by the extruded piece 2 as it passes therethrough.

The die 10, backer 14 and bolster 18 are clamped by a clamping device in a die ring 20 (FIG. 2). At its front, ring 20 includes an inward protruding annular front rim 21 which engages a matching rim 10*a* in the front face of die 10. The complete stack is clamped against the rim 21 and is held in place thereagainst. The present invention, although primarily intended for molding of die 10, can also be used for molding the backer, bolster and ring.

The term "die blank" as used herein is intended to include castings which have no core or center void and castings which are cored. The term "blank" is considered applicable even to cored die blanks since the cores are preferably made slightly smaller in cross-sectional shape than the finally desired die aperture shape so that some precision EDM machining is allowed for. It is anticipated that some minor work would have to be done on the aperture, in almost every conceivable situation and accordingly, the term "die blank" is considered appropriate even for cored blanks. The term "related tooling" refers to the backer, bolster and die ring used in conjunction with the die.

The Preferred Embodiment Mold

Figure 3:
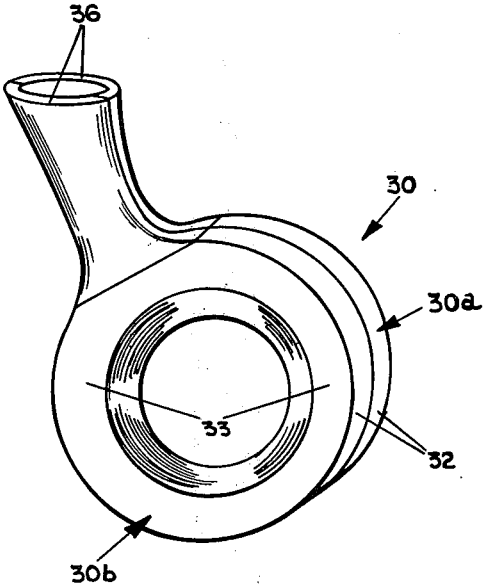
FIG. 3 is a perspective view of a mold made in accordance with the present invention, with the sprue insulating blanket not shown for convenience.
Figure 5:
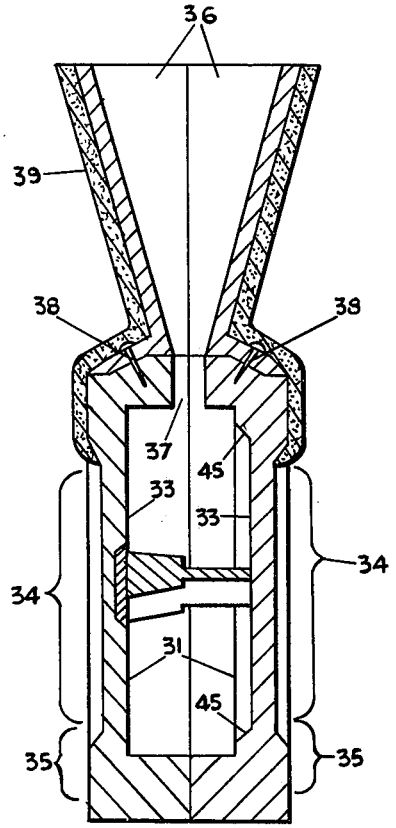
FIG. 5 is a cross-sectional view taken along plane V—V of FIG. 3, with a sprue blanket, not shown in FIG. 3, being shown in FIG. 5.
Figure 4:
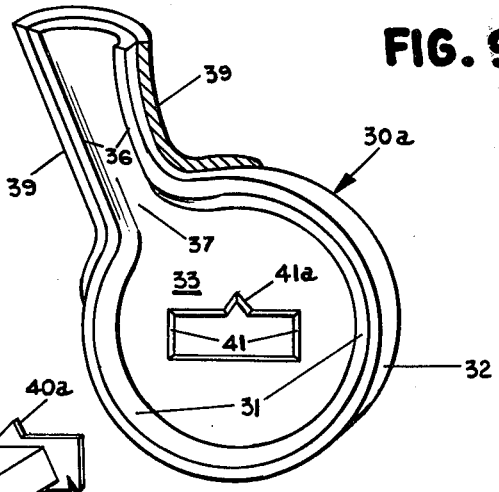
FIG. 4 is a view of one-half of the mold shown in FIG. 3, with a "foot" and attached core exploded away from the mold.
Figure 4:
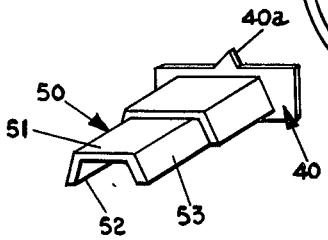

The preferred embodiment mold 30, shown in FIGS. 3, 4 and 5, comprises two mold halves 30*a* and 30*b*, both essentially the same, made of a relatively permanent mold material such as carbon. This makes the mold per se reuseable numerous times. The mold halves, with the exception of the sprue 36, are machined from carbon bar stock. Carbon is preferably used because it readily radiates heat through walls which are sufficiently thick to resist molding pressures. Other permanent steel mold materials such as ceramics can be used. Further, fiber glass dipped in ceramic material can be used as backing or reinforcement for the carbon mold.

Each mold half includes half of a peripheral edge wall 32 joining a pair of spaced side walls 33. Each side wall 33 in turn includes a center portion 34 which is substantially reduced in thickness compared to the rest of the mold and a peripheral side wall portion 35 which surrounds the center portion 34. Center side wall portion 34 is sufficiently large in diameter that it is at least larger than the area required to accomodate a die aperture in the finished die (which is to be made from a die blank cast in mold 30).

In a carbon mold, the wall thickness of the center portion 34 will be from one-quarter to three-eighths of an inch. The wall thickness of the peripheral side wall portions 35 increases relatively sharply to a thickness of about threequarters of an inch. The peripheral edge walls also have a thickness of about three-quarters of an inch.

Mold 30 also includes a sprue 36. Sprue 36 is more easily provided by molding it from a ceramic material, whereas the rest of the mold 30 can readily be machined from carbon bar stock. Thus, each half of sprue 36 is preferably made separately to a wall thickness of about one-quarter inch and attached to its respective mold half 30*a* or 30*b* by means of suitable pins or screws 38 and a conventionally available ceramic cement (FIG. 5). To ensure that heat radiates more rapidly from the central portion 34 of side walls 33 than from the walls of sprue 36, each sprue half is provided with a sprue insulating blanket 39. Blanket 39 extends downwardly somewhat around the upper peripheral side wall portions 35 of side walls 33. This keeps sprue 36 and the upper portions of peripheral sidewalls 35 hot the longest, thereby ensuring a supply of molten steel to other parts of the mold and facilitating venting during the entire cooling process. The insulating blanket has a thickness of about one-half inch. Such insulating blankets are conventionally available for steel molding applications and can comprise, for example, fiber glass material dipped in a suitable ceramic material.

Sprue 36 is oriented generally tangentially on mold peripheral edge wall 32 and in fact opens into the interior mold cavity 31 through an opening 37 in the peripheral edge wall 32. The purpose of preferably orienting sprue 36 generally tangentially along the peripheral edge wall is to reduce turbulence within the mold cavity 31 during the filling step of the method. A molten steel poured through the sprue tends to flow smoothly in a generally circular pattern around the periphery of the interior of the mold cavity 31 and turbulence, particularly in the central area of the mold cavity, i.e., the area bracketed by central portions 34 of the side walls 33, tends to be less turbulent than would otherwise be the case. It is important that the opening 37 into the interior cavity 31 extend approximately to the top center of the mold 30 so that gasses gathering at the top of the mold during the pouring will flow upwardly out through the sprue 36 rather than being trapped at the top of the mold cavity 31. Venting at the top could also be done to accomplish this result.

In addition to providing an insulating blanket around sprue 36, one may also pour a conventional exothermic material into the top of the sprue after the steel has been poured into the mold to further ensure that the sprue area cools more slowly than the central portion of the mold through central portion 34 of side walls 33. Also in addition to sprue 36, it may be desirable in some cases to provide small additional vents in the upper portions of the mold to further vent undesired gasses.

Mold half 30*a* also includes a recessed area or footprint 41. It is shaped to receive a correspondingly configurative mold insert or foot 40. Foot 40 is designed to provide a means for optionally attaching a core 50 thereto and in turn conveniently inserting core 50 into the mold cavity 31. In FIG. 4, foot 40 is shown having a core 50 attached thereto. Foot 40 includes a locating indicia or point 40*a* which is received within a corresponding portion 41*a* of footprint 41. The edge walls of footprint 41 and foot 40 are tapered downwardly from front to rear to facilitate insertion of foot 40 into print 41.

Mold half 30*b* includes a rim defining projection 45 which gives shape to the rim engaging rim portion 10*a* of die 10. Footprint 41 and rim defining projection 45 represent the only significant differences in the mold halves 30*a* and 30*b*.

The Preferred Mold Core

The mold core 50 discussed briefly above is preferably a non-permanent member made of shell core sand. It is shaped to correspond in cross-sectional configuration generally to the desired die aperture for the finished die 10. Core 50 is adhered by suitable adhesive to foot 40 for insertion into the mold cavity 31 via foot 40 being positioned in footprint 41. Core 50 is sufficiently long that it extends from foot 40 all the way into abutting engagement with the inside of the opposite side wall 33 of the opposite mold half 30*b*. In some cases, it may be desirable to actually provide a separate foot for the opposite side wall and provide a core member 50 extending therefrom, with the oppositely extending core portions meeting in the middle of the interior cavity 31 of mold 30. Basically, the result is the same in that the core 50 extends generally from one side wall of mold 30 to the other.

Core 50 corresponds generally in shape to the finally desired die aperture 11 for die 10. However, it is preferably somewhat smaller in cross-sectional configuration to ensure that some final EDM machining of the die aperture is required. This way, one is sure that the die aperture as molded will not be too large. Additionally, one will have an opportunity to remove the thin decarburization layer from the inside surface of the die aperture.

In addition, core 50 deviates slightly from the finally desired die aperture configuration in the orientation of any appendages or legs which the core 50 has. For purposes of illustration, core 50 is shown having a bite portion 51 and spaced extending legs 52 and 53 (FIG. 4). Whereas the final die aperture is intended to have a corresponding bite portion and legs so as to facilitate the extrusion of an extruded piece 2 as shown in FIG. 1, the final die aperture has legs which are oriented perpendicular to the bite portion of the die aperture. Similarly, the legs 2*b* and 2*c* of extruded piece 2 are oriented perpendicularly to bite portion 2*a*. In contrast, the legs 52 and 53 of core 50 are bowed slightly outwardly so as to make an obtuse, inside angle with respect to bite portion 51. Providing such outward orientation of depending appendages is done for the purpose of allowing for shrinkage for the molten steel as it cools.

Figure 6:
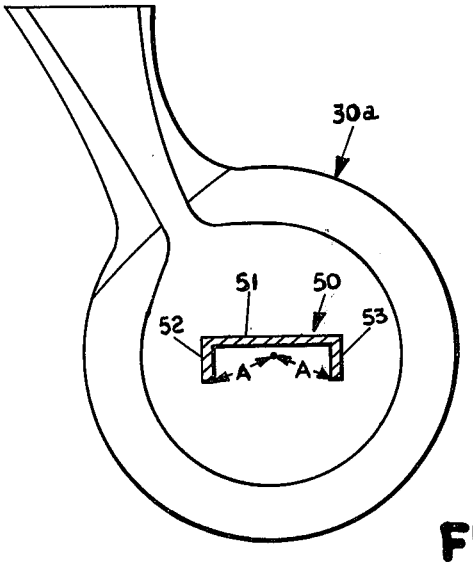
FIG. 6 is an elevational view of a mold half with a theoretical core attached thereto for illustrative purposes.
Figure 7:
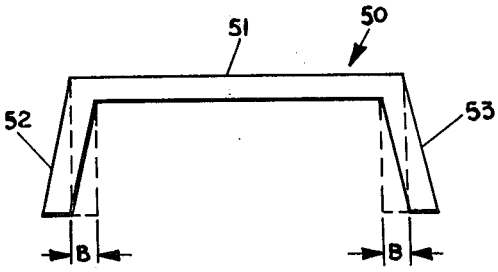
FIG. 7, is an elevational end view of a core having the shape it has when inserted into the mold, with its final shape being shown in phantom.

The degree of such compensation required can be approximated by determining the distance of the free end of an appendage 52 or 53 from the center of the mold, multiplying that distance by the shrinkage factor for the molten steel being poured and spacing the free end of the appendage 52 outwardly a distance from its desired final position equal to the resultant multiplication product. Referring to FIG. 6, the finally desired shape for a core 50, after the molten steel in the mold has solidified, is shown drawn in its desired position against a mold half 30*a*. The distance of the free end of each appendage 52 and 53 from the center of the mold half 30*a* is represented by the distance A, in this case equal for both legs 52 and 53. The distance A is multiplied by a shrink factor K for the molten steel and the resultant multiplication product B represents the distance which the free ends of the legs 52 and 53 must be bowed outwardly. Thus, FIG. 7 shows a finally desired configuration in phantom and an actual shape for a core 50 in solid lines in which the difference between the actual starting position shown in solid and the finally desired shape shown in phantom is the distance B. Preferably, the bite portion 51 of the core 50 is located at or almost at the center of the mold so that the shrinking steel will not create any bowing in the bite.

Of course it will be appreciated that these same principles can be employed to design other cores having appendages oriented at angles to one another. If the core is to have a simple regular cross-sectional shape such as a square or rectangle, one need only be sure to locate it generally at the center of the mold in order to avoid bowing problems. However, extending appendages should be oriented in accordance with the above principles.

The Mold Press

Figure 8:
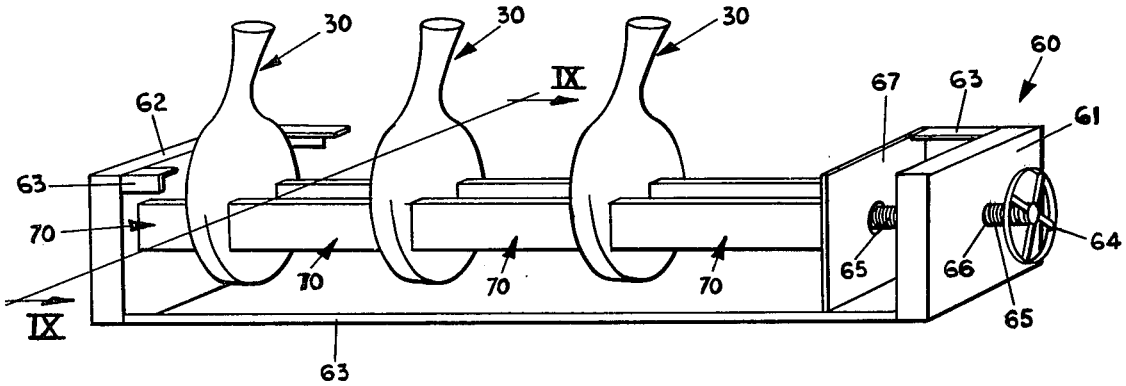
FIG. 8 is a perspective view of the mold clamping apparatus employed in the present invention.
Figure 9:
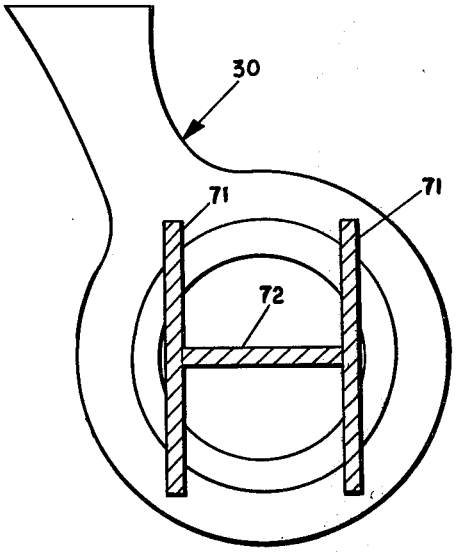
FIG. 9 is a cross-sectional view of the apparatus taken along plane IX—IX of FIG. 8.

FIGS. 8 and 9 show the mold press 60 used to hold a plurality of molds 30 made in accordance with the present invention. Press 60 is preferably made of steel plates and angles and comprises an end plate 61 and an end plate 62 joined by four angle iron beams 63. The top beams are shown broken away for convenience. A pressure plate 67 is provided which is adapted for movement along beams 63 toward and away from end plate 61. A threaded shaft 65 is rotatably journalled at one end on pressure plate 67 and is threadably received within a threaded bearing 66 in end plate 61. A large hand wheel 64 is secured to the other end of threaded shaft 65 to facilitate turning of the shaft and to thereby cause pressure plate 67 to move towards or away from end plate 61.

A plurality of generally H cross-sectional shaped spacers 70 are provided for spacing the molds 30 from one another and from end plate 62 and pressure plate 67. Each spacer 70 comprises a pair of legs 71 joined by a cross piece 72. Spacers 70 are preferably made of three-eighths inch steel. It is important that spacers 70 be at least approximately 4 inches long so as to space molds 30 a distance sufficient to allow heat radiating from the mold surfaces, particularly the central portions 34 of side walls 33, to be carried away from the area of the molds. Additionally, it is important that the spacers 70 be open in cross-section so that they do not themselves serve to insulate the molds and thereby prevent heat from radiating away from the mold, particularly in the central portions 34 of side walls 33.

Method And Operation

In operation, one begins by ensuring that foot 40 is inserted into footprint 41 at the outset. The friction between the two parts should be sufficient to hold foot 40 in place. Foot 40 is inserted in place regardless of whether or not the die blank to be molded is to have a void made by a core 50. If it is to have a void, a core 50 is adhered to foot 40 before it is inserted into footprint 41. If not, foot 40 will be inserted to ensure that the face of the resulting die blank is smooth and does not have a raised portion in the area of footprint 41.

With foot 40 in place, the mold halves 30*a* and 30*b* are placed together and are oriented in mold press 60 with the sprues 36 extending generally vertically upwardly in the manner illustrated in FIG. 3 and in FIG. 8. Spacers 70 are inserted between the molds and between the end molds and the end plate 62 and pressure plate 67 respectively and wheel 65 is rotated to tighten the molds in place. The pressure of mold press 60 on the mold halves 30*a* and 30*b*is typically sufficient to hold them tightly together and prevent steel from excessively flashing through the crack between the mold halves. Ceramic cement can be used if necessary to ensure that mold halves are properly held together.

With the molds 30 in place in press 60, molten steel of a desired chemistry is poured through the sprues 36 into the interior cavity 31 of the molds. Because of the thinner central portions 34 of side walls 33, the mold and the molten steel therein are cooled more rapidly at the center portions of both the spaced side walls 33 than at the peripheral portions 35 of side walls 33, and are cooled more rapidly at the central portions 34 than at the peripheral edge wall 32 of the mold and at the sprue 36 of the mold. Accordingly, the steel is solidified most rapidly at the center of the die blank disc which is forming in the mold cavity.

Once the molten steel has solidified, the mold press 60 is opened and the mold halves 30*a* and 30*b* are separated. The solid steel die blank is removed from the mold and the surface decarburization layer of the solid steel disc is removed at least in the center portion of at least one side of the disc, namely that side of the disc which will face the aluminum bar stock as it passes through an aperture formed in the center portion of the disc. Preferably, the entire surface layer of the die blank is so removed. This removes the decarburization layer of the cast material which typically has a depth of only about 0.015 inches. Normal machining techniques are used to remove this decarburization layer.

A final aluminum extrusion die can now readily be made from the die blank formed in accordance with the present invention. If the die blank has been cored, i.e., formed with a void, one need only EDM to a slight extent in order to finally shape the die aperture. If the die blank has been formed without any core, the EDM process will require more time.

Conclusion

The die which is formed from a die blank made in accordance with the present invention will have a die aperture which is free of porosity and which facilitates the production of high quality aluminum extrusions. Re-melted, worn die steel can be used to mold the die blanks of the present invention. Further, the chemistry of the steel can be modified or altered on a given casting to compensate the precise needs of aluminum extrusion dies.

The method and apparatus can also be used to mold the related tooling used in the die stock. By molding a cored ring, backer or bolster using the present invention, one gets a product which is not weakened by porosity and yet which does not have to be extensively machined as bar stock does. This yields a savings in material as well as labor.

The present invention constitutes a significant contribution to the art and accordingly, it will be understood that the above is merely a preferred embodiment of the invention. Various changes and alterations can be made without departing from the broader aspects and spirit of the invention.

The embodiments of the invention in which an exclusive property or privilege are claimed are described as follows: f

1. A method for casting aluminum extrusion die blanks comprising: providing a mold having spaced side walls joined by a peripheral edge wall to thereby define a disc-like mold cavity, said mold side walls each having a center portion slightly larger in surface area than the area required to form a desired die aperture in the steel disc to be molded, and said mold side walls each including a peripheral portion extending from said center portion to said peripheral edge wall, said mold further including a sprue opening into said cavity at a point spaced from said center portions of said side walls; casting into said mold through said sprue a molten steel of a type suitable for forming aluminum extrusion dies; cooling the mold and the molten steel therein more rapidly at said center portions of both said side walls than at said peripheral portions thereof and more rapidly than at said peripheral edge wall and said sprue of said mold to thereby solidify and steel most rapidly and with the least porosity at the center of the disc being formed in said mold cavity; removing the resulting solid steel disc from said mold and removing the decarburization surface layer of said solid steel disc at least in the center portion of at least one side of said disc.

2. The method of claim 1 wherein said step of said cooling said mold and said molten steel more rapidly at said center portions of both said spaced side walls comprises providing said mold with side walls which are thinner in said center portions thereof than at said peripheral portions of said side walls and thinner than said peripheral edge wall.

3. The method of claim 2 which includes providing for said sprue to open into said mold cavity through an aperture in said peripheral edge wall.

4. The method of claim 3 which includes orienting said sprue generally tangentially with respect to said mold cavity that the flow of molten steel into said mold is generally tangential and turbulence-free, particularly at the center of the mold.

5. The method of claim 4 which includes providing an insulating blanket on said sprue of said mold.

6. The method of claim 4 which includes making at least said side walls and peripheral edge wall of said mold of carbon.

7. The method of claim 1 which includes:

providing a core having a cross-sectional shape approximately corresponding to that desired for a final die aperture, but being slightly smaller in cross section than the finally desired die aperture;

placing said core in the interior of said mold such that it extends between said center portions of said spaced sidewalls;

finally machining a die aperture around the cored area after said steel disc has been removed from the mold.

8. The method of claim 7 which includes providing a core having at least two appendages oriented at an angle to one another at least one having a free end, and shaping said core such that at least one said appendage is bowed outwardly slightly from the position they should have after the disc has been formed to compensate for shrinkage of the molten steel as it cools.

9. The method of claim 8 which includes bowing at least one said appendage outwardly such that said free end of at least one appendage is displaced from the position finally desired after the molten steel has cooled by an amount equal to the distance of said free end from the center of the mold multiplied by the shrinkage factor for the steel being cast.

10. The method of claim 8 in which said core is made out of a material which disintegrates when the steel is cast.

11. The method of claim 10 in which said core is made of core shell sand.

12. The method of claim 9 wherein said step of said cooling said mold and said molten steel more rapidly at said center portions of both said spaced side walls comprises providing said mold with side walls which are thinner in said center portions thereof than at said peripheral portions of said side walls and thinner than said peripheral edge wall.

13. The method of claim 12 which includes providing for said sprue to open into said mold cavity through an aperture in said peripheral edge wall.

14. The method of claim 13 which includes orienting said sprue generally tangentially with respect to said mold cavity such that the flow of molten steel into said mold is generally tangential and turbulence-free, particularly at the center of the mold.

15. The method of claim 7 wherein said step of said cooling said mold and said molten steel more rapidly at said center portions of both said spaced side walls comprises providing said mold with side walls which are thinner in said center portions thereof than at said peripheral portions of said side walls and thinner than said peripheral edge wall.

16. The method of claim 1 which includes placing said mold in a press and positioning spacers having relatively open cross section and having sufficient length to space the sides of the mold away from any adjacent molds or portions of the press on either side of said mold to permit heat radiating from said mold to be readily carried away from said mold.

17. Apparatus for casting aluminum extrusion die blanks and related tooling comrising:

a mold having spaced side walls joined by a peripheral edge wall to thereby define a disc-like mold cavity; said mold side walls each having a center portion slightly larger in surface area than the area required to form a desired die aperture in the steel disc to be molded, and said mold side walls each including a peripheral portion extending from said center portion to said peripheral edge wall; said mold further including a sprue opening into said cavity at a point spaced from said center portions of said side walls; said mold side walls being thinner in said center portions thereof than at said peripheral portions of said side walls and thinner than said peripheral edge wall whereby heat radiates more quickly from the center of said mold, from both side walls thereof, than from the peripheral portions of said mold side walls and forms an aluminum extrusion die blank of less porosity at portions adjacent the center of said mold than at portions adjacent the peripheral portions of said mold side walls.

18. The apparatus of claim 17 in which said sprue opens into said mold cavity through an aperture in said peripheral edge wall.

19. The apparatus of claim 18 in which said sprue is oriented generally tangentially with respect to said mold cavity such that the flow of molten steel in said mold is generally tangential and turbulence free, particularly at the center of said mold.

20. The apparatus of claim 19 which includes an insulating blanket located on said sprue of said mold, but not extending sufficiently far off of said sprue to cover said central portions of said side walls thereby providing for greater heat radiation from said central portions of said side walls.

21. The apparatus of claim 19 in which at least said side walls and said peripheral edge wall of said mold are made of carbon.

22. The apparatus of claim 21 in which said central portion of each said side wall of said mold is approximately one quarter of an inch thick, said peripheral portions of said side walls tapering to a greater thickness of approximately three-quarters of an inch and said peripheral edge wall having a thickness of approximately three-quarters of an inch.

23. The apparatus of claim 17 which further includes a core for placing in the interior of said mold, said core having a length sufficiently great that it extends between said center portions of said spaced side walls; said core having a shape approximately corresponding to that desired for a die aperture to be made in a steel disc molded in said mold, and said core cross sectional shape being slightly smaller than the shape desired for said die aperture.

24. The apparatus of claim 23 in which said core includes at least two appendages, at least one having a free end, oriented at an angle to one another, said appendage having a free end being oriented at an outwardly bowed position with respect to the position finally desired for said leg after steel is cast into said mold and cooled such that shrinkage of said steel as it cools is compensated for.

25. The apparatus of claim 24 in which said free end of said appendage is offset from the position finally desired therefor by a distance away from the center of the mold which is equal to the distance of said free end from the center of said mold multiplied by the shrinkage factor for molten steel as it solidifies in said mold.

26. The apparatus of claim 25 in which said core is made of a material which disintegrates when steel is cast therearound.

27. The apparatus of claim 26 in which said core is made of core shell sand.

28. The apparatus of claim 27 which further includes a press for holding said mold, said press including at least one end plate and a press plate spaced from said end plate;

means for moving said press plate toward or away from said end plate;

and at least two spacers for each mold to be placed in said press, each said spacer having a relatively open cross-sectional configuration so that when placed adjacent the side of a mold it does not insulate said mold and each said spacer having a length sufficiently long to space adjacent objects a sufficient distance away from the side of a mold in said press to allow heat being radiated by said mold to be readily carried away from said mold.

* * * * *

UNITED STATES PATENT AND TRADEMARK OFFICE

CERTIFICATE OF CORRECTION

PATENT NO. : 4,005,511

DATED : February 1, 1977

INVENTOR(S) : Jay H. Muusse

It is certified that error appears in the above-identified patent and that said Letters Patent are hereby corrected as shown below:

Column 2, line 20, "an pt" should read -- and kept --.

Column 4, line 22:
"threequarters" should be ---three-quarters---;
Column 7, line 24:
"30bis" should be --- 30b is ---;
Column 7, line 28:
After "that" insert ---the---;
Column 8, line 19:
After "follows:" delete ---f---;
Column 8, line 21:
After "blanks" insert ---and related tooling---;
Column 8, line 37:
After "solidify" delete "and" and substitute therefor ---said---;
Column 8, line 56:
After "cavity" insert ---such---;
Column 9, line 56:
"comrising" should be ---comprising---;
Column 10, line 63:
"27" should be ---17---.

Signed and Sealed this

Twenty-eighth Day of June 1977

[SEAL]

*Attest:*

RUTH C. MASON
*Attesting Officer*

C. MARSHALL DANN
*Commissioner of Patents and Trademarks*